United States Patent [19]

Defrance

[11] Patent Number: 4,820,483

[45] Date of Patent: Apr. 11, 1989

[54] PROCESS FOR THE PRODUCTION OF CHROMIUM-ALUMINUM BALLS FOR ADDING CHROMIUM INTO MOLTEN ALUMINUM BATHS

[75] Inventor: Alain Defrance, Les Loges en Josas, France

[73] Assignee: Delachaux SA, France

[21] Appl. No.: 137,661

[22] Filed: Dec. 22, 1987

[30] Foreign Application Priority Data

Dec. 22, 1986 [FR] France ..... 86 17981

[51] Int. Cl.[4] ..... B22F 1/00

[52] U.S. Cl. ..... 419/23; 419/30; 419/33; 419/66; 75/245; 420/528; 420/590

[58] Field of Search ..... 419/23, 33, 30, 66; 75/245; 420/528, 590

[56] References Cited

U.S. PATENT DOCUMENTS

| | | | |
|---|---|---|---|
| 3,969,103 | 7/1976 | Capes et al. | 75/3 |
| 4,564,393 | 1/1986 | Murray et al. | 75/68 R |
| 4,648,901 | 3/1987 | Murray et al. | 75/68 R |
| 4,689,199 | 8/1987 | Eckert et al. | 75/10.1 |

FOREIGN PATENT DOCUMENTS 229499 7/1987 European Pat. Off. .

*Primary Examiner*—Stephen J. Lechert, Jr.
*Attorney, Agent, or Firm*—McCormick, Paulding & Huber

[57] ABSTRACT

The present invention relates to a process for the production of chromium-aluminum balls for adding chromium into molten aluminum baths.

In order to obtain balls containing x% of chromium and y% of aluminum, where x and y are gravimetric contents corresponding to the following relationships:

$$70 \leqq x \leqq 80$$

$$20 \leqq y \leqq 30$$

$$x + y = 100$$

an alloy of chromium and aluminum containing gravimetric chromium and aluminum contents approximating to x by an excess and to y by a deficit respectively is prepared by melting and this alloy is then finely ground into a crude powder; the chromium and aluminum contents of the alloy or of the crude powder are determined and, if required, an additional amount of finely divided aluminum is added so as to obtain a powder containing x% of chromium and y% of aluminum, the additional amount of finely divided aluminum corresponding to less than 10% by weight of the crude powder; a compacting is then carried out.

Balls essentially consisting of alloy particles having the same melting point and little risk of floating on the surface of the molten aluminum bath, which favors the dissolution of the balls in the latter, are produced.

12 Claims, No Drawings

PROCESS FOR THE PRODUCTION OF CHROMIUM-ALUMINUM BALLS FOR ADDING CHROMIUM INTO MOLTEN ALUMINUM BATHS

The present invention relates to a process for the production of chromium-aluminum balls for adding chromium into molten aluminum baths.

More precisely, it relates to the production of such balls containing x % of chromium and y % of aluminum, where x and y are gravimetric contents corresponding to the following relationships:

$$70 \leqq x \leqq 80$$

$$20 \leqq y \leqq 30$$

$$x+y=100$$

by producing a powder containing x % of chromium and y % of aluminum and then compacting this powder into balls.

According to a known process, described in U.S. Pat. No. 3,592,637, balls intended for adding chromium into molten aluminum baths are produced by compacting a powder which is obtained by mixing a quantity of the order of 10% to 90% of a finely divided material consisting of chromium or a chromium alloy, and approximately 10 to 90% of finely divided aluminum, of which the presence, in this form, is described, in this U.S. patent, as being indispensible in order to ensure the subsequent dissolution of the balls in the molten aluminum bath.

Now, it appears that balls obtained by this known process are not entirely satisfactory; in fact, each ball consists of two heterogeneous components, viz. aluminum particles on the one hand and optionally alloyed chromium particles on the other, which components have different behaviors; in fact, the generally lower particle size of the aluminum powder which forms a major part of the composition of the balls results in a part of this powder being separated from the remaining part of the balls so as to come to float at the surface of the aluminum bath with which this powder does not combine satisfactorily; additionally, the aluminum particles and the optionally alloyed chromium particles melt at different temperatures, with the result that their dissolution in the aluminum bath occurs in an unsatisfactory manner.

U.S. Pat. No. 4,564,393 describes another process which essentially differs from the process described in U.S. Pat. No. 3,592,637 in that a flux is added to the mixture of the aluminum powder and the optionally alloyed chromium powder, before compacting into balls; the balls produced by this process have a heterogeneity comparable to that of the balls produced according to the teachings of U.S. Pat. No. 3,592,637, with the same results, and additionally having the disadvantage of being more expensive because of the addition of flux.

The object of the present invention is to overcome these disadvantages by providing a process which makes it possible to produce economically balls having an exact chromium and aluminum content, with a homogeneity favorable for a most satisfactory dissolution when they are incorporated into a molten aluminum bath.

To this end, the present invention proposes to produce a powder containing x % of chromium and y % of aluminum, where x and y are defined as mentioned above, by a succession of stages consisting in:

(a) producing, by melting, an alloy of Cr and Al containing gravimetric Cr and Al contents approximating x by an excess and y by a deficit respectively, (b) finely grinding said alloy into a crude powder and analyzing the gravimetric Cr and Al contents respectively in said alloy or in said crude powder, and (c) if the gravimetric Al content of the alloy or Qf the crude powder is less than y, adding to the crude powder an additional amount of finely divided Al in order to obtain said powder containing x % of Cr and y % of Al, said additional amount of finely divided Al corresponding to less than 10% by weight of the crude powder.

The balls resulting from compacting the powder thus obtained have the entire amount or at least the essential part of their aluminum content in the form of chromium-aluminum alloy particles having a homogeneous content of these two components and consequently melting at identical temperatures, which temperatures are found to be lower than those of aluminum or of chromium considered separately, with the result that the dissolution of the balls occurs in a particularly favorable manner; the optional additional amount of finely divided aluminum is only employed for adjusting the aluminum content, in proportions which may be reduced to less than 5% by weight of the crude powder and for example less than 2% or of the order of approximately 2% of the weight of the crude powder, due to a careful alloying of chromium and aluminum, which makes the disadvantages inherent to the presence of aluminum in the form of a metal powder, i.e. the heterogeneity of melting point and the risk of floating of this powder, virtually negligible.

In contrast, the optional additional amount of aluminum powder contributes to the compactness of the balls, i.e. contributes towards avoiding too high a friability of the latter.

To this end, it is also possible to add to the powder, before compacting, a binder which is advantageously a carbon-containing binder such as bakelite, which binder is added in sufficiently small proportions so as not to have an effect on the behavior of the balls when they are sunk into a molten aluminum bath; naturally, the compacting process is chosen by the person skilled in the art depending on whether the binder is absent or the binder is present, as well as on the nature of the binder.

Other features and advantages of the invention will emerge from the description below, which relates to a non-limiting embodiment.

In this example, it is desired to produce balls containing 75% of chromium and 25% of aluminum and, for this purpose, an alloy of chromium and aluminum having gravimetric chromium and aluminum contents approximating to 75% by an excess and 25% by a deficit respectively is first produced by melting, for example by the thermite process.

The alloy thus produced is then finely ground into a crude powder having a particle size advantageously between approximately 0.250 mm and approximately 0.053 mm and this crude powder, or alternatively the alloy itself, is analyzed in order to determine the gravimetric chromium content and the gravimetric aluminum content of the crude powder or of the alloy.

If these contents correspond to the values sought of 75% and 25% respectively, no addition of aluminum powder is necessary.

If, on the other hand, the gravimetric aluminum content of the crude powder or of the alloy is less than the 25% sought, an additional amount of aluminum in the finely divided form is added so as to adjust the aluminum content to the required value of 25% and the chromium content to the required value of 75%; experience shows that by a careful control of the thermite process employed for the production of the alloy of chromium and aluminum, the addition of aluminum in the form of a finely divided aluminum powder may be reduced to approximately 2% or to less than 2% by weight of the chromium-aluminum alloy powder; the finely divided aluminum which is thus optionally added to the crude powder advantageously has a particle size less than 420 μm, with a proportion of aluminum powder having a particle size less than 53 μm not exceeding 15% of the total weight of aluminum thus optionally added.

In either case, a powder containing, as acurately as possible, 25% of chromium and 75% of aluminum is thus obtained.

This powder advantageously has a density of the order of 2.5±0.2.

Subsequently, bakelite is preferably added to this powder, at a rate of approximately 0.2% by weight of bakelite relative to the weight of the powder containing 25% of chromium and 75% of aluminum, the compacting is then carried out at a pressure and at a temperature, which can readily be determined by a person skilled in art, suited to give the balls obtained by this compacting a density advantageously of the order of 5.6±0.2 and to cause the bakelite to set; the balls are then ready for use.

The addition of a binder is preferred insofar as it prevents the balls from producing dust; experience has shown that the presence of a small quantity of aluminum in the form of a powder, in the non-alloyed state, enables the quantity of binder required to be reduced considerably and makes the presence of this binder to have no effect on the aluminum bath; this quantity of aluminum in the form of a powder, in the non-alloyed state, is, for example, of the order of 2% by weight of the weight of the chromium-aluminum alloy powder.

However, as a variant, it is also possible to omit the use of any binder by performing an appropriate compacting.

Naturally, the implementation of the process according to the invention is not restricted to the production of balls containing 75% of chromium and 25% of aluminum and this process may also be applied, with the same advantages, for chromium contents ranging from 70 to 80%, with the remaining percentage required to make up to 100%, of aluminum.

In each case, care is taken to avoid the disadvantages related to the presence of too large a quantity of non-alloyed aluminum in the form of a powder, by adjusting as accurately as possible the chromium and aluminum contents of the alloy so as to reduce the additional amount of non-alloyed aluminum added in the form of a powder to this alloy, to as low a value as possible below 10%; in each case, the particle sizes and densities mentioned above are preferably observed, which particle sizes and densities are currently regarded as preferable, although other values may also be chosen without thereby departing from the scope of the present invention.

I claim:

1. A process for the production of balls containing x % of Cr and y % of Al where x and y are gravimetric contents corresponding to the following relationships:

$$70 \leqq x \leqq 80$$

$$20 \leqq y \leqq 30$$

$$x+y=100$$

for adding Cr into molten aluminum baths, by producing a powder containing x % of Cr and y % of Al and then compacting this powder into balls, wherein said powder is produced by a succession of stages consisting in:

(a) producing, by melting, an alloy of Cr and Al containing gravimetric Cr and Al contents approximating x by an excess and y by a deficit respectively, (b) finely grinding said alloy into a crude powder and analyzing the gravimetric Cr and Al contents respectively in said alloy or in said crude powder, and (c) if the gravimetric Al content of the alloy or of the crude powder is less than y, adding to the crude powder an additional amount of finely divided Al in order to obtain said powder containing x % of Cr and y % of Al, said additional amount of finely divided Al corresponding to less than 10% by weight of the crude powder.

2. The process as claimed in claim 1, wherein said alloy of Cr and Al is produced in stage (a) by the thermite process.

3. The process as claimed in claim 1, wherein said alloy of Cr and Al is produced in stage (a), with gravimetric Cr and Al contents sufficiently approximating to x and y respectively so that said additional amount of finely divided Al corresponds to less than 5% by weight of the crude powder.

4. The process as claimed in claim 3, wherein said alloy of Cr and Al is produced in stage (a), with gravimetric Cr and Al contents sufficiently approximating to x and y respectively so that said additional amount of finely divided Al corresponds to approximately 2% by weight of the crude powder.

5. The process as claimed in claim 1, wherein the crude powder has a particle size of between approximately 0.250 mm and approximately 0.053 mm.

6. The process as claimed in claim 1, wherein the additional amount of finely divided aluminum has a particle size less than 420 μm.

7. The process as claimed in claim 6, wherein not more than 15% by weight of the additional amount of finely divided aluminum has a particle size less than 53 μm.

8. The process as claimed in claim 1, wherein the powder containing x % of Cr and y % of Al has a density of the order of 2.5±0.2 and a ball has a density of the order of 5.6+0.2.

9. The process as claimed in claim 1, wherein a binder is added to the powder before compacting.

10. The process as claimed in claim 9, wherein the binder is a carbon-containing binder.

11. The process as claimed in claim 9 , wherein the binder is bakelite.

12. The process as claimed in claim 1, wherein the binder is added at a rate of approximately 0.2% by weight of the powder containing x % of Cr and y % of Al, before compacting.

* * * * *